US005523633A

United States Patent [19]

Imaizumi et al.

[11] Patent Number: 5,523,633

[45] Date of Patent: Jun. 4, 1996

[54] CORROSION PREVENTING CIRCUIT FOR SWITCH

[75] Inventors: Nobuhiro Imaizumi; Masashi Watanabe; Osamu Souda; Hiroyuki Ashiya; Masataka Suzuki, all of Shizuoka, Japan

[73] Assignee: Yazaki Corporation, Tokyo, Japan

[21] Appl. No.: 96,000

[22] Filed: Jul. 23, 1993

[30] Foreign Application Priority Data

Jul. 30, 1992 [JP] Japan ..... 4-203513
Jun. 11, 1993 [JP] Japan ..... 5-140353

[51] Int. Cl.[6] ..... H01H 1/60

[52] U.S. Cl. ..... 307/137; 361/3

[58] Field of Search ..... 367/137, 138; 361/1–13, 10; 307/95

[56] References Cited

U.S. PATENT DOCUMENTS 3,925,707 12/1975 Bhate et al. ..... 317/11 A
4,011,464 3/1977 Robbi ..... 307/137
4,459,629 7/1984 Titus ..... 361/3
4,550,356 10/1985 Takahashi ..... 361/9
4,851,707 7/1989 Lindsay ..... 307/137
4,914,315 4/1990 Nickolai ..... 307/137
5,119,261 1/1992 Sonntagbauer ..... 361/2

*Primary Examiner*—Peter S. Wong
*Assistant Examiner*—Aditya Krishnan
*Attorney, Agent, or Firm*—Sughrue, Mion, Zinn, Macpeak & Seas

[57] ABSTRACT

Disclosed is a corrosion preventing circuit for a switch which, even if a large current switch is used for a small current system such as an electronic unit, can improve long-term durability of the switch in a manner similar to the present level without increasing the burden on the system side, thereby ensuring the reliability of devices belonging to the system. A series circuit consisting of a switching means and a current limiting resistor is connected in parallel to a resistor that is connected in series between a dc power supply and a large current switch. A control circuit turns on the switching means by generating a pulse of a predetermined time width after a predetermined time in accordance with the turning on of the large current switch. The current flowing while the switching means is being turned on is applied to the large current switch, so that an oxide film formed at the contact of the switch is destroyed.

6 Claims, 3 Drawing Sheets

BATT
2
11
11a
CONTROL CIRCUIT
Tr
R3
D
R1
R2
1
FIG. 2(a) STATE OF SWITCH 1
ON
OFF
FIG. 2(b) INPUT OF CONTROL CIRCUIT 11a
H
L
FIG. 2(c) CONDITION OF Tr
ON
OFF
FIG. 2(d) CURRENT OF SWITCH 1
100mA
5mA
0
t0
t1
t2
t3
100ms
10~50ms

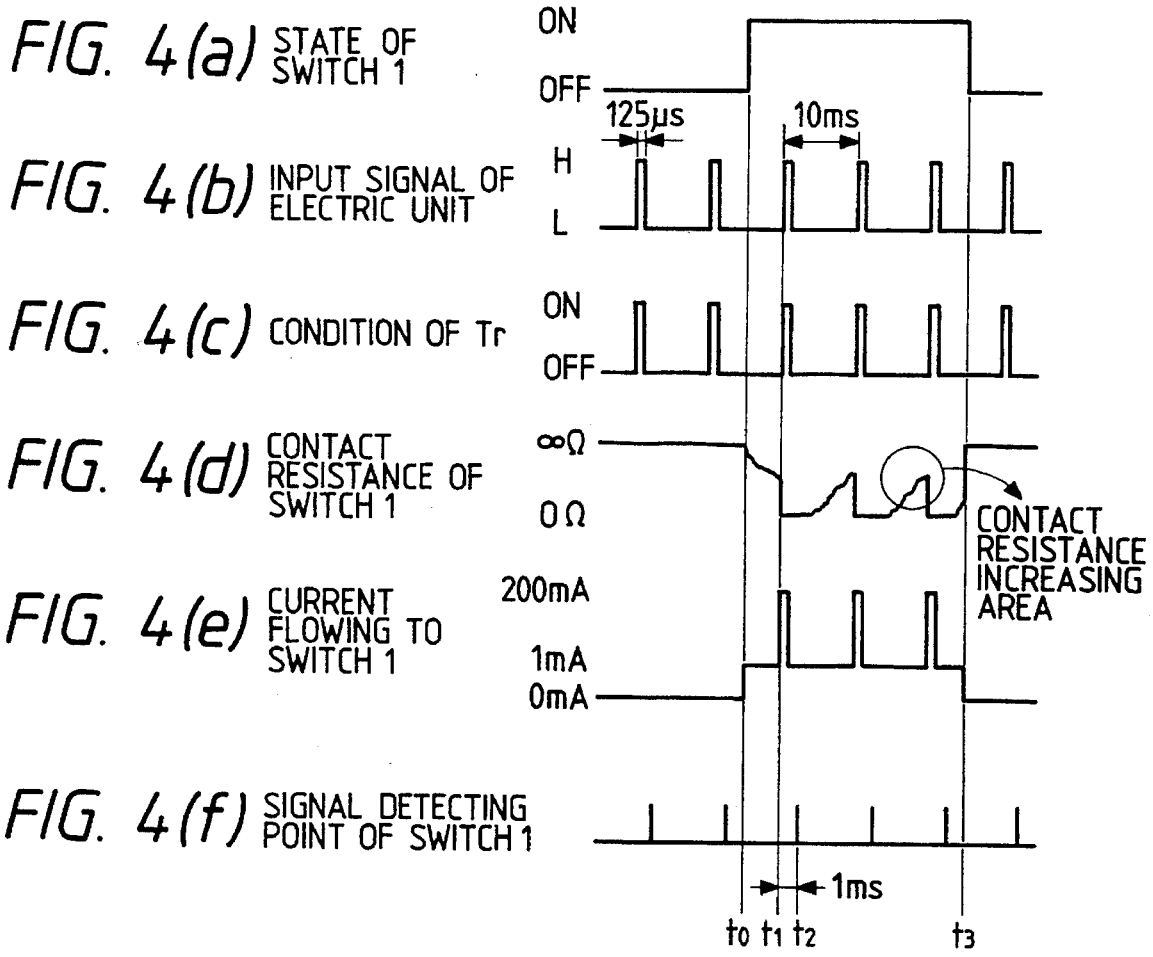
FIG. 5
PRIOR ART
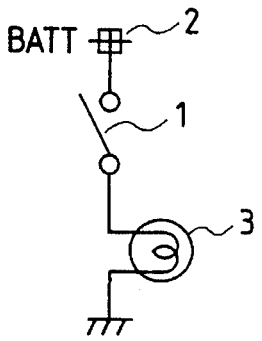

CORROSION PREVENTING CIRCUIT FOR SWITCH

BACKGROUND OF THE INVENTION

1. Field of the Invention

The invention relates to corrosion preventing circuits for a switch, and more particularly to a corrosion preventing circuit for a switch which allows a large current switch carried on a vehicle or the like to be applied to a lower power system such as an electronic unit.

2. Prior Art

FIG. 5 is a circuit diagram showing connection of a switch generally used for opening and closing large current (e.g., 500 mA, 1 A, etc.) carried on a vehicle or the like. In FIG. 5, reference numeral 1 designates a large current switch; 2, a battery serving as a dc power supply that supplies a power supply voltage to a load, whose voltage is, e.g., 12 V; and 3, a 12 W lamp as the load.

The switch 1 that is carried on a vehicle in current use is designed so that a comparatively large current such as 500 mA or 1 A can flow therethrough. Therefore, the contact of such switch 1 is not plated, but is made of a copper in many cases as far as the treatment and material of the contact thereof is concerned.

Switches such as this which is suitable for making and breaking large current have the shortcoming that oxide films are formed at the contact of the switch and that the contact resistance of the contact tends to increase. However, it is difficult for the switches handling large current to destroy the oxide films formed at the contacts thereof by applying a large current such as about 1 A while the switch is being closed or opened.

Amid rapid development in unitizing electronic devices using LSIs (Large-Scale Integrated circuit) into modules not only in the field of vehicles but also in other fields, the signal input stage of such electronic module still uses existing mechanically strong power switches in many cases.

FIG. 6 is a circuit diagram showing connection when a large current switch such as described above is applied to an electronic unit. In FIG. 6, reference numerals 1 to 3 designate the same parts and components as those in FIG. 5; and 4, designates an electronic unit. The electronic unit 4 includes a resistor R10 for pulling up or down an input of an interface circuit (not shown); and a resistor R11 for connecting the node between the resistor R10 and the switch 1 to the interface circuit (not shown).

In the thus constructed electronic unit 4, it is required that such a small current as to be considered equivalently a signal be applied to the switch 1, and the value of current to be applied to the contact of the switch 1 is determined by the pull-up or pull-down resistor R10 of the electronic unit 4. The current value, being slightly different from one electronic unit to another, is determined by the capacity of the electronic unit 4 or of the pull-up or pull-down resistor R10. The value is in the order to several mA to 10 mA.

As described above, if a large current switch carried on a vehicle or the like is used for the signal input stage of a small current system such as an electronic unit, then a current flowing through the switch takes a small value defined by the electronic unit. Therefore, if an oxide film is formed at the contact of the switch 1, the contact resistance of the switch 1 is increased, thereby imposing the problem that the electronic unit cannot detect the state of the switch 1.

What is required to protect the contact of the switch 1 is to destroy the oxide film formed at the contact of the switch.

However, to apply a large current, the capacity of the pull-up or pull-down resistor R10 must be 2 W or more. A pull-up or pull-down resistor R10 having a large capacity is disadvantageous in terms not only of cost of the resistor, but also of construction of the circuit. That is, a cooling means must be involved to control heating of the resistor, which is a bottleneck from the viewpoint of downsizing the electronic unit.

SUMMARY OF THE INVENTION

The invention has been made in view of the above problems. Accordingly, an object of the invention is to provide a corrosion preventing circuit for a switch by which a large current switch can be applied to a signal input stage of a small current electronic unit.

Another object of the invention is to provide a corrosion preventing circuit for a switch, which, when a large current switch is used for a small current system such as an electronic unit, can not only maintain long-term durability without increasing the burden on the system side, but also ensure reliability of devices belonging to the system.

To achieve the above object, a first aspect of the invention is applied to a corrosion preventing circuit for a switch receiving a direct current through a series resistor. This corrosion preventing circuit includes: a series circuit consisting of a switching means connected in parallel to the series resistor and a current limiting resistor; and a signal generating means for supplying a pulse to the switching means. In such corrosion preventing circuit, when the switch is turned on, a pulsed current is supplied to the switch through the switching means so that an oxide film formed at a contact of the switch can be destroyed.

A second aspect of the invention is applied to a corrosion preventing circuit for a switch which includes: a series circuit consisting of a switching means and a current limiting resistor; and a control circuit for turning on the switching means by generating a signal of a predetermined pulse width after a predetermined time from a timing at which the switch has turned on. The switching means is connected in parallel to a resistor connected in series between a direct current power supply and the switch. In such corrosion preventing circuit, a current flowing while the switching means is being turned on is caused to flow through the switch so that an oxide film produced at a node of the switch can be destroyed.

A third aspect of the invention is applied to a corrosion preventing circuit for a switch which includes: a series circuit consisting of a switching means and a current limiting resistor; and a signal generating means for supplying a pulse to the switching means at a predetermined cycle at all times. The switching means being connected in parallel to a resistor connected in series between a direct current power supply and the switch. In such corrosion preventing circuit, when the switch has turned on, a current is applied to the switch through the switching means in synchronism with the pulse from the signal generating means, so that an oxide film formed at a contact of the switch can be destroyed.

As a result of the above construction, the corrosion preventing circuit for a switch according to the invention allows a large current switch to be used as a switch for a signal input stage of a small current electronic unit by destroying an oxide film formed at the contact of the switch by supplying a pulsed large current to the contact of the switch when the switch serving as a signal input stage has turned on.

Further, the corrosion preventing circuit for a switch according to the invention allows a large current switch to be used as a switch for a signal input stage of a small current electronic unit by destroying an oxide film at the contact of the switch while applying a relatively large current to the switch when the switch serving as a signal input stage has turned on, the current value of the switch has then reached a steady state, and a predetermined time has lapsed thereafter.

Still further, the corrosion preventing circuit for a switch according to the invention allows a large current switch to be used as a switch for a signal input stage of a small current electronic unit by supplying a pulse to the switching means at all times and destroying an oxide film formed at the contact of the switch by applying a relatively large current to the contact of the switch for a predetermined time period at a predetermined cycle in synchronism with the pulse when the switch serving as a signal input stage has turned on.

BRIEF DESCRIPTION OF THE DRAWINGS

FIGS. 2(*a*)–2(*d*) is a timing chart showing states of various parts of the circuit shown in FIG. 1;

FIGS. 4(*a*)–4(*f*) is a timing chart showing states of various parts of the circuit shown in FIG. 3;

FIG. 5 is a circuit diagram showing connections of a large current switch used for a vehicle in current use.

DETAILED DESCRIPTION OF THE PREFERRED EMBODIMENTS

Corrosion preventing circuits for switches, which are embodiments of the invention, will hereunder be described with reference to the drawings.

Figure 1:
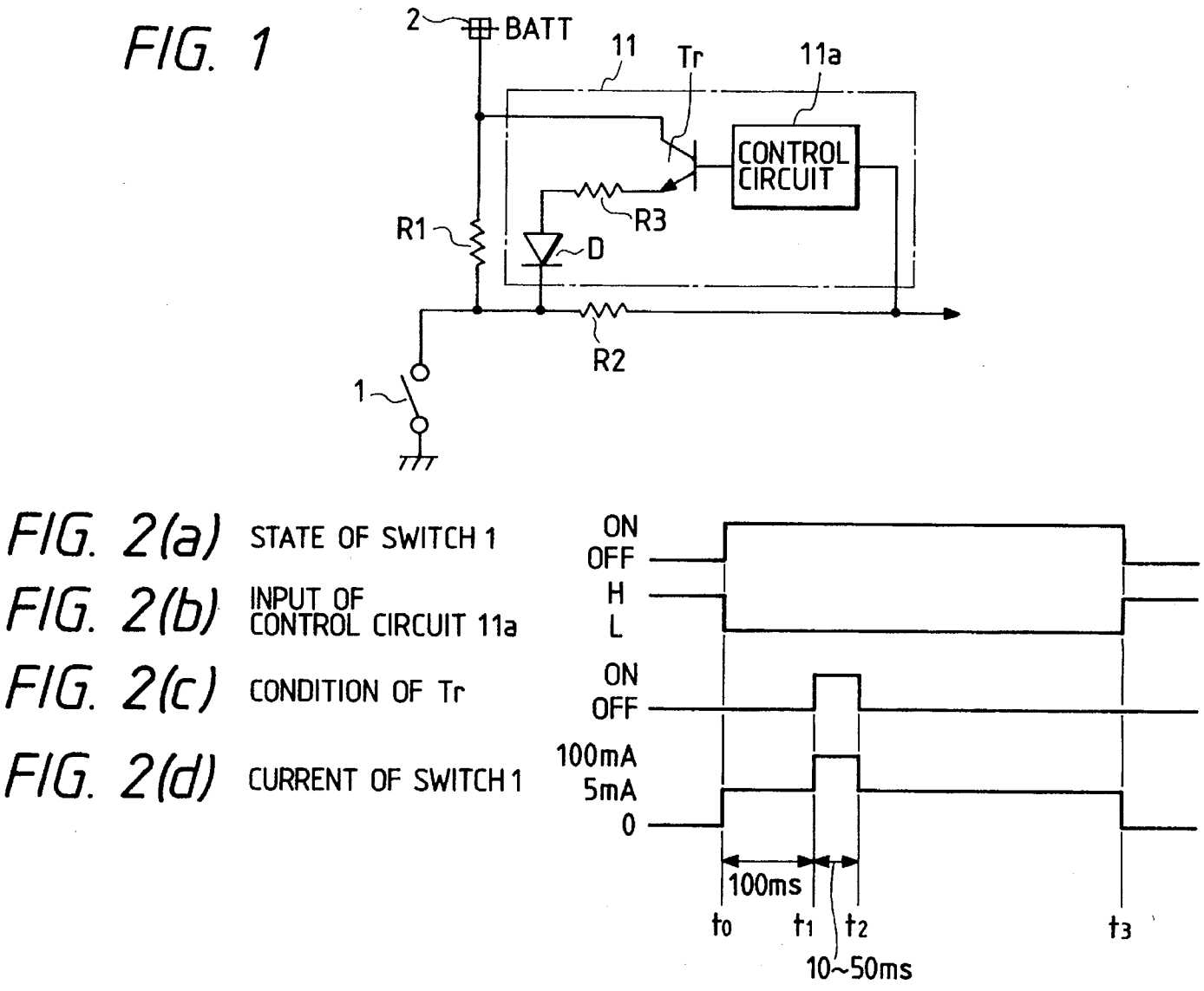
FIG. 1 is a circuit diagram showing a corrosion preventing circuit for a switch, which is an embodiment of the invention.
Figure 6:
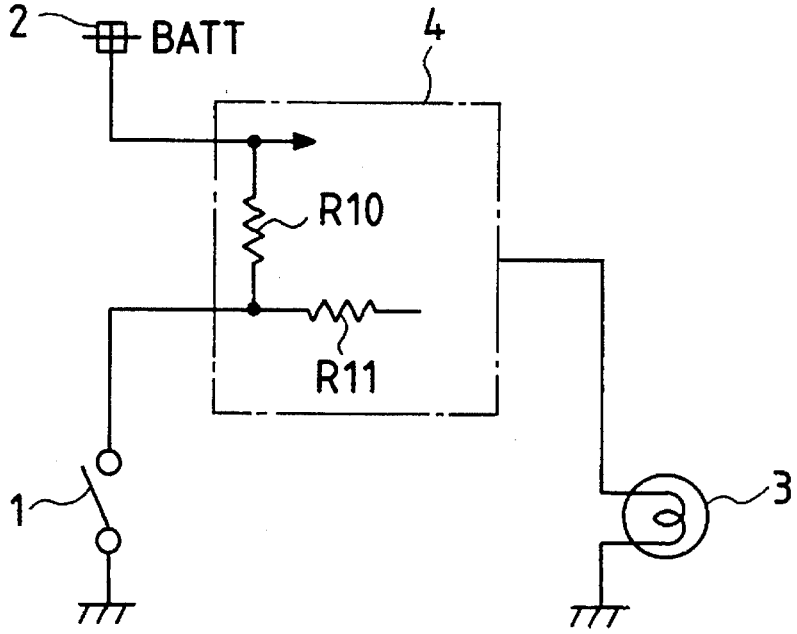
FIG. 6 PRIOR ART
FIG. 6 is a circuit diagram showing connections when the large current switch of FIG. 5 is applied to a small current system.

FIG. 1 shows a corrosion preventing circuit for a switch, which is an embodiment of the invention. In FIG. 1, the same or like parts and components as in FIGS. 5 and 6 are designated by the same reference characters.

In FIG. 1, reference numerals 1 and 2 designate a switch and a battery, respectively, which are the same as those in the conventional example; R1, R2, resistors; and 11, a corrosion preventing circuit for a switch. The corrosion preventing circuit 11 includes: a switching transistor Tr; a series circuit consisting of a current limiting resistor R3 and a diode D for preventing reverse flow of current; and a control circuit 11*a* for controlling the switching of the switching transistor Tr. The collector of the switching transistor Tr is connected to the resistor R1 and the battery 2; the emitter thereof, to one end of the current limiting resistor R3; the other end of the current limiting resistor R3, to the anode of the diode D; the cathode of the diode D, to a node of the resistors R1, R2 and the switch 1. The input terminal of the control circuit 11*a* is connected to the other end of the resistor R2 and a node of an interface (not shown).

The control circuit 11*a* includes a circuit combining a delay circuit and a one-shot circuit. When an input of the control circuit 11*a* goes low, an output thereof goes high about 100 ms later, and a pulse maintaining the high level is outputted for 10 to 50 ms thereafter. The output pulse of the control circuit 11*a* is applied to the base of the switching transistor Tr, whereby the switching transistor Tr is turned on. When the switching transistor Tr has been turned on, a large current such as about 100 mA is fed to the switch 1 through the resistor R3 and the diode D.

Then, the operation of the corrosion preventing circuit, which is one of the embodiments of the invention, will be described in detail with reference to a timing chart shown in FIG. 2.

FIG. 2(*a*) shows a state of the switch 1. The switch 1 turns on while closed at timing $t_0$ and turns off while opened at timing $t_3$. When the switch 1 has been turned on at timing $t_0$, about 5 mA of current flows through the resistor R1 and the switch 1 as shown in FIG. 2(*d*). Simultaneously therewith, the input of the control circuit 11*a*, which has been pulled up to the high level, goes low as shown in FIG. 2(*b*). In accordance with such switching from high to low, the one-shot circuit within the control circuit 11*a* generates a pulse at timing $t_1$, that is about 100 ms after such switching. The output of the pulse then causes the output of the control circuit 11*a* to go high from low at timing $t_1$.

As shown in FIG. 2(*c*), the output pulse of the control circuit 11*a* is applied to the base of the switching transistor Tr, so that the switching transistor Tr turns on at timing $t_1$. Upon turning on of the switching transistor Tr, current flows to the switch 1 through the switching transistor Tr, the resistor R3 and the diode D. As a result, the current value of the switch 1 increases to 100 mA from 5 mA as shown in FIG. 2(*d*).

The output pulse of the control circuit 11*a* lasts for 10 to 50 ms. The switching transistor Tr turns off at timing $t_2$ at which the pulse falls as shown in FIG. 2(*c*). In association therewith, the value of the current flowing through the switch 1 decreases to 100 mA from 5 mA as shown in FIG. 2(*d*) to return to the steady state.

As shown in FIG. 2(*d*), the switch 1 turns off at timing $t_3$, so that current no longer flows through the switch 1. As a result, the input of the control circuit 11*a* goes high.

As described above, the switching transistor Tr turns on for 10 to 50 ms after a predetermined time from the closing of the switch 1, or after 100 ms from timing $t_0$ in FIG. 2, so that about 100 mA of current flows through the switch 1. As a result, an oxide film formed at the node of the switch 1 is destroyed, so that the initial condition of contact can be maintained at the contact. Thus, even a large current switch can supply a signal by small current to an electronic unit.

The switching transistor Tr allows 100 mA of current to flow for such a short period of 50 ms in the thus constructed corrosion preventing circuit. Therefore, a resistor having such a small value as about ⅕ W can be used as the resistor R3 connected in series with the switching transistor Tr if it is supposed that the on/off repeating cycle of the switch 1 is set to 1 second.

Figure 3:
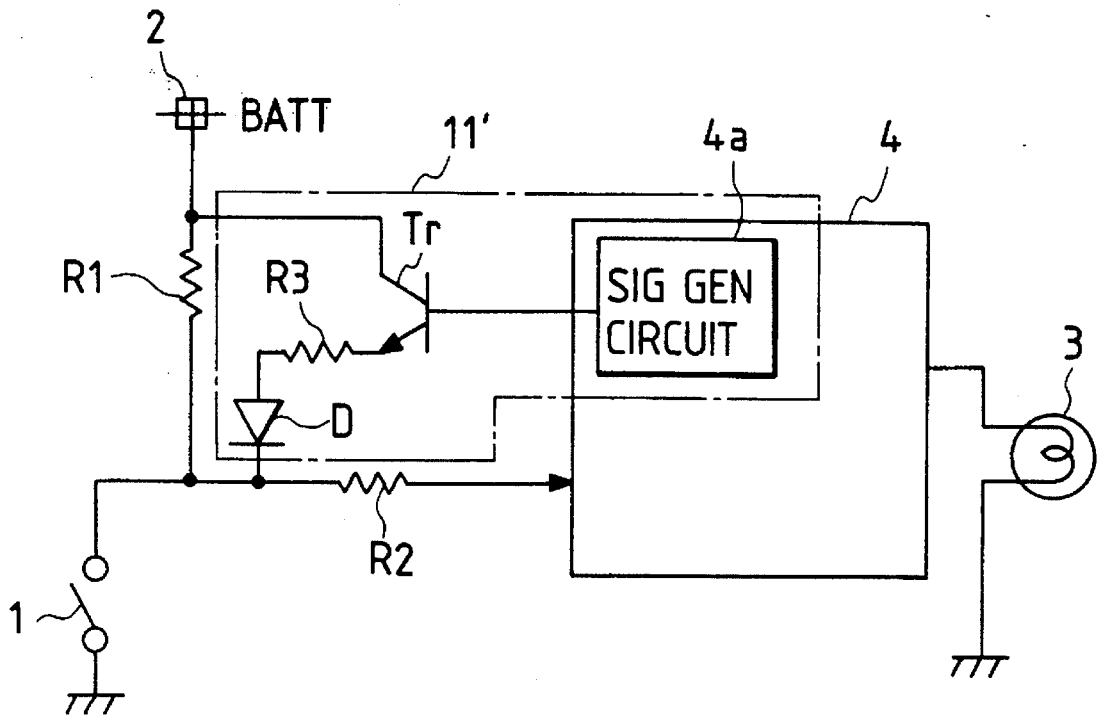
FIG. 3 is a circuit diagram showing a corrosion preventing circuit for a switch, which is another embodiment of the invention.

FIG. 3 shows a corrosion preventing circuit for a switch, which is another embodiment of the invention. The same parts and components as in FIG. 1 are designated by the same reference characters.

In FIG. 3, a corrosion preventing circuit 11' includes: a switching transistor Tr; a current limiting resistor R3; a reverse flow preventing diode D; and a signal generating circuit 4*a*. The collector of the transistor Tr is connected to one end of a resistor R1 and a battery 2; the emitter of the transistor Tr, to one end of the resistor R3; the other end of the resistor R3, to the anode of the diode D; and the cathode of the diode D, to the resistors R1, R2 and a switch 1. The base of the transistor Tr is connected to an output terminal of the signal generating circuit 4a. The other end of the resistor R2 is connected to an input terminal of an electronic unit 4. The signal generating circuit 4a converts a synchronizing signal of the electronic unit 4 into a predetermined pulse and supplies the pulse to the base of the transistor Tr. The signal generating circuit 4a may be arranged outside the electronic unit 4. A signal from the switch 1 is processed within the electronic unit 4 to thereby turn on a lamp 3 or the like.

The operation of the embodiment shown in FIG. 3 will be described with reference to a timing chart shown in FIG. 4.

FIG. 4(*a*) shows a state of the switch 1. The switch 1 turns on at timing $t_0$ to and turns off at timing $t_3$. FIG. 4 (*b*) shows an input signal to be supplied to the base of the switching transistor Tr. A pulse whose width is, e.g., 125 μs is fed at all times to the base of the switching transistor Tr at a cycle of 10 ms through the signal generating circuit 4a of the electronic unit 4. Therefore, the switching transistor Tr turns on and off in synchronism with the output pulse from the signal generating circuit 4a as shown in FIG. 4(*c*). As shown in FIG. 4(*e*), about 1 mA of current flows through the switch 1 through the resistor R1 at timing $t_0$ at which the switch 1 turns on, and then synchronizes with the pulse from the signal generating circuit 4a at timing $t_1$ to allow about 200 mA of current to flow through the switch 1 via the switching transistor Tr, the resistor R3 and the diode D. Since about 200 mA of pulsed current flows through the contact of the switch 1 at a cycle of 10 ms during a period from timings $t_0$ to $t_3$, the contact resistance at the contact of the switch 1 is decreased.

As shown in FIG. 4(*d*), the contact resistance of the switch 1 decreases gradually from an infinite level with 1 mA of current flowing at timing $t_0$ to about 3 Ω with some 200 mA flowing at the contact of the switch 1 at timing $t_1$. Although the contact resistance gradually increases thereafter, the contact resistance of the switch 1 is decreased again to about 3 Ω by 200 mA of a next pulsed current. While the switch 1 is turned on (from timing $t_0$ to timing $t_3$), the contact resistance of the contact of the switch 1 can be maintained at a small value while repeating this operation. Therefore, even if a small current is supplied while the switch 1 is turned on, the signal can be sent to the electronic unit 4 since the contact resistance of the large current switch is set to a small value.

As shown in FIG. 4(*f*), the signal indicating that the switch 1 is turned on can be applied to the electronic unit 4 at a timing synchronized with the output pulse from the signal generating circuit 4a of the electronic unit 4.

The contact resistance of the switch 1 is decreased under the following equation.

$$R=K\times I_{-A}$$

where R is the contact resistance after an oxide film has been destroyed; I is the current flowing through the switch 1; and K and A are coefficients.

In the case of the above embodiment, a limited current is 200 mA and an input frequency is 100 Hz. Therefore, if the pulse width is within 125 μs, a resistor of 1.4 W can be used satisfactorily as the resistor R2.

While the reverse flow preventing diode D is connected to the series circuit consisting of the switching transistor Tr and the resistor R3 in the embodiments shown in FIGS. 1 and 3, the reverse flow preventing diode D is not required as long as the switching transistor Tr is a switching element that exhibits excellent reverse withstand voltage characteristics.

Even if the large current switch is used at the signal input stage of the electronic unit., the contact resistance of the switch can be decreased by causing 100 to 200 mA of pulsed current to flow through the large current switch. As a result, the contact resistance of the large current switch can be maintained at an initial condition, thereby allowing the large current switch to be used as the signal input stage of the electronic unit.

Further, since large current is supplied at a predetermined cycle while the switch is being turned on, the contact resistance of the switch can be further decreased, thereby allowing a stable signal to be sent.

As described in the foregoing pages, the invention is characterized as destroying an oxide film formed at the contact of a switch by causing a relatively large current to flow through a large current switch for a short period after a predetermined time from the timing at which the large current switch has turned on.

Therefore, even if the large current switch carried by a vehicle or the like is used for a small current system such as an electronic unit, the contact of the large current switch can be maintained at an initial condition at all times. As a result, the long-term durability of the switch can be maintained in a manner similar to the present level without increasing the burden on the system side, which thereby provides the advantage of ensuring reliability of the devices belonging to the vehicle or the like;

The invention is further characterized as causing the corrosion preventing circuit to constantly receive a pulse from the electronic unit, so that a large current flows to the switch at a cycle synchronized with the pulse from the electronic unit while the large current switch is being turned on. Therefore, even if the switch is used for a small current system such as en electronic unit, an oxide film formed on the contact of the switch can be destroyed, thereby effectively decreasing the contact resistance of the switch. The long-term durability of the switch can therefore be maintained in a manner similar to the present level without increasing the burden on the system side, thereby providing the advantage of ensuring reliability of the devices belonging to the vehicle or the like.

What is claimed is:

1. A corrosion preventing device for a switch comprising:

a direct power supply connected to said switch through a resistor in series therebetween;

corrosion preventing circuit for destroying an oxide film formed on a contact of said switch, said corrosion preventing circuit being connected in parallel to said resister connected in series between said direct circuit supply and said switch.

2. A corrosion preventing device for a switch as claimed in claim 1, wherein said corrosion preventing circuit includes:

a series circuit including a switching member and a current limiting resister, said series circuit being connected in parallel to said resister; and a control circuit for controlling said series circuit, said control circuit connected to said series circuit.

3. A corrosion preventing device as claimed in claim 2, wherein said control circuit turns on said switching member by generating a signal of a predetermined pulse width after a predetermined time from a timing at which said switch is turned on.

4. A corrosion preventing device as claimed in claim 2, wherein said control circuit supplies a pulse current to said switch through said switching member when said switch turns on.

5. A corrosion preventing circuit as claimed in claim 2, wherein said control circuit includes:

a signal generating circuit for supplying a pulse to said switching member at a predetermined cycle at all times.

6. A corrosion preventing device as claimed in claim 5, wherein when said switch is turned on, a current is applied to said switch through said switching member in synchronism with said pulse from said signal generating circuit.

* * * * *